US010233607B2

(12) United States Patent
Niroumand

(10) Patent No.: US 10,233,607 B2
(45) Date of Patent: Mar. 19, 2019

(54) COMPREHENSIVE EXCAVATION PROCESS

(71) Applicant: Bahman Niroumand, Boushehr Port (IR)

(72) Inventor: Bahman Niroumand, Boushehr Port (IR)

( * ) Notice: Subject to any disclaimer, the term of this patent is extended or adjusted under 35 U.S.C. 154(b) by 0 days.

(21) Appl. No.: 15/821,769

(22) Filed: Nov. 23, 2017

(65) Prior Publication Data

US 2018/0230665 A1 Aug. 16, 2018

(30) Foreign Application Priority Data

Feb. 12, 2017 (IR) ..... 13955014000301442

(51) Int. Cl.

| | |
|---|---|
| ***E02D 3/10*** | (2006.01) |
| ***E02D 29/02*** | (2006.01) |
| ***E21B 43/12*** | (2006.01) |
| ***E21B 43/04*** | (2006.01) |
| ***E02D 19/10*** | (2006.01) |
| *E21B 7/20* | (2006.01) |

(52) U.S. Cl.

CPC ..... *E02D 29/0283* (2013.01); *E02D 19/10* (2013.01); *E02D 29/0233* (2013.01); *E21B 43/04* (2013.01); *E21B 43/121* (2013.01); *E02D 2250/003* (2013.01); *E02D 2250/0023* (2013.01); *E02D 2600/40* (2013.01); *E21B 7/205* (2013.01)

(58) Field of Classification Search

CPC .... E02D 5/22; E02D 5/30; E02D 5/34; E02D 5/38; E02D 5/54; E02D 7/00; E02D 11/00; E02D 23/00; E02D 29/02; E02D 29/0225; E02D 29/0233; E02D 29/0241; E02D 29/0266; E02D 29/0275; E02D 29/0283; E02D 19/10; E02D 2250/003; E02D 2250/0023; E02D 2600/40; E02D 3/10; E21D 21/00; E21B 43/121; E21B 43/04; E21B 7/205

USPC ..... 405/36, 43–45, 49, 50, 231–233, 235, 405/236, 243, 245, 249, 257, 128, 129, 405/239, 244, 256, 259.1, 262, 284, 285, 405/287, 302.4, 302.6; 166/51, 278, 276, 166/205, 267, 369, 370, 371, 372, 68, 67, 166/245, 246, 311, 253, 68.5, 254, 230, 166/314; 210/611, 747, 170, 901; 175/20, 22, 23, 58, 314

See application file for complete search history.

(56) References Cited

U.S. PATENT DOCUMENTS

| | | | | |
|---|---|---|---|---|
| 191,876 A * | 6/1877 | Mesler | E02B 11/005 | 405/43 |
| 790,910 A * | 5/1905 | McClintook | E02D 7/30 | 111/7.1 |
| 951,668 A * | 3/1910 | Welsh | E02D 5/385 | 405/243 |
| 1,530,221 A * | 3/1925 | Uren | E21B 7/18 | 166/222 |

(Continued)

*Primary Examiner* — Benjamin F Fiorello
*Assistant Examiner* — Edwin J Toledo-Duran

(57) ABSTRACT

Disclosed is a comprehensive excavation process performed on an excavation site. The process includes installing wellpoints for lowering the groundwater level within the excavation site and stabilizing the boundary soil walls of the excavation site by an improved soil nailing method. The improved soil nailing method employs casing pipes that are part of the wellpoint system as reinforcing elements for the stabilization of the soil walls.

16 Claims, 10 Drawing Sheets

(56) References Cited

U.S. PATENT DOCUMENTS 1,688,356 A * 10/1928 Romney ..... E02D 19/10 166/157
2,127,175 A * 8/1938 Imbertson ..... E02D 19/10 405/50
2,326,155 A * 8/1943 Mccook ..... E02D 5/38 405/243
2,636,355 A * 4/1953 Thornley ..... E02D 5/385 173/128
3,215,213 A * 11/1965 Morimoto ..... E02D 19/10 166/230
3,451,348 A * 6/1969 Tatsuo ..... E02D 19/10 417/513
3,839,874 A * 10/1974 Wyant ..... E02D 5/38 405/233
4,124,982 A * 11/1978 Fuller ..... E02D 3/10 405/232
4,176,716 A * 12/1979 Bielaczek ..... E03B 3/18 175/20
4,199,272 A * 4/1980 Lacey ..... E03B 3/15 166/51
4,223,724 A * 9/1980 Levoni ..... E03B 3/15 166/68
4,348,058 A * 9/1982 Coakley ..... E21B 21/10 175/213
4,448,689 A * 5/1984 von Nordenskjold ..... B01D 21/0027 210/521
4,623,025 A * 11/1986 Verstraeten ..... E02D 5/62 175/21
4,883,589 A * 11/1989 Konon ..... B01D 17/0202 210/140
4,898,495 A * 2/1990 Lin ..... E02B 3/023 405/73
4,934,865 A * 6/1990 Varkonyi ..... E02B 11/00 405/267
4,982,788 A * 1/1991 Donnelly ..... B09C 1/005 166/267
5,050,676 A * 9/1991 Hess ..... B09C 1/005 166/267
5,099,917 A * 3/1992 Roser ..... E21B 43/04 166/242.9
5,172,764 A * 12/1992 Hajali ..... B09C 1/005 166/267
5,183,110 A * 2/1993 Logan ..... E21B 43/04 166/278
5,279,740 A * 1/1994 Basile ..... B09C 1/005 166/246
5,358,357 A * 10/1994 Mancini ..... B09C 1/005 166/268
5,449,253 A * 9/1995 Roger ..... E02D 5/72 405/232
5,472,294 A * 12/1995 Billings ..... B09C 1/00 166/246
5,611,402 A * 3/1997 Welsh ..... B09C 1/005 166/369
5,655,852 A * 8/1997 Duffney ..... B09C 1/005 166/306
5,829,530 A * 11/1998 Nolen ..... E21B 47/042 166/369
5,906,241 A * 5/1999 Pehlivan ..... E03B 3/12 166/372
6,158,512 A * 12/2000 Unsgaard ..... E21B 37/08 166/105.1
6,224,757 B1 * 5/2001 Van Der Westhuysen ..... B01F 3/04262 210/170.07
6,306,296 B1 * 10/2001 Kerfoot ..... B01F 3/04262 210/170.07
6,402,432 B1 * 6/2002 England ..... E02D 5/44 175/267
6,854,929 B2 * 2/2005 Vinegar ..... B09C 1/00 405/128.4
7,033,109 B2 * 4/2006 Russell ..... E02D 3/10 405/259.1
7,326,004 B2 * 2/2008 Wissmann ..... E02D 3/08 405/245
7,901,159 B2 * 3/2011 Fox ..... E02D 3/08 175/424
8,152,415 B2 * 4/2012 Fox ..... E02D 5/44 175/424
8,740,501 B2 * 6/2014 Maher ..... E02D 3/046 405/233
9,840,835 B2 * 12/2017 Niroumand ..... E02D 1/00
2004/0028480 A1 * 2/2004 Verstraeten ..... E02D 5/32 405/233
2004/0031603 A1 * 2/2004 Minamijima ..... E02D 3/10 166/68.5
2004/0099300 A1 * 5/2004 Warren ..... E04H 15/62 135/118
2004/0129855 A1 * 7/2004 Chen ..... E04H 17/263 248/545
2004/0213636 A1 * 10/2004 Russell ..... E02D 3/10 405/184.4
2005/0056422 A1 * 3/2005 Harrington ..... B09C 1/002 166/265
2006/0110224 A1 * 5/2006 Bodegom ..... E02D 3/10 405/302.4
2006/0137872 A1 * 6/2006 Steinbrecher ..... E21B 28/00 166/248
2006/0147274 A1 * 7/2006 Ding ..... E02D 5/44 405/237
2007/0077128 A1 * 4/2007 Wissmann ..... E02D 3/046 405/232
2007/0127988 A1 * 6/2007 Nakakuma ..... E02D 3/10 405/36
2007/0283866 A1 * 12/2007 Veazey ..... B63B 3/04 114/77 R
2008/0193223 A1 * 8/2008 Wissmann ..... E02D 3/08 405/229
2009/0290940 A1 * 11/2009 Martin, Sr. ..... E02D 3/123 405/232
2010/0028087 A1 * 2/2010 Wissmann ..... E02D 3/08 405/240
2010/0266341 A1 * 10/2010 Poerio ..... E03B 3/10 405/107
2011/0243666 A1 * 10/2011 Fox ..... E02D 3/08 405/232
2012/0097387 A1 * 4/2012 Nillert ..... E03B 3/15 166/205
2013/0051927 A1 * 2/2013 Kruse ..... E02D 13/10 405/233
2013/0177359 A1 * 7/2013 Hamata ..... E02D 15/04 405/240
2013/0195560 A1 * 8/2013 Siepi ..... E02D 27/12 405/232
2015/0330051 A1 * 11/2015 White ..... E02D 27/18 405/249
2018/0201531 A1 * 7/2018 Cohen ..... B09C 1/002

* cited by examiner

Step 1 Step 2 Step 3 Step 4 Step 5 Step 6

COMPREHENSIVE EXCAVATION PROCESS

BACKGROUND OF THE INVENTION

In spite of the growth and development of many methods of soil wall stabilization, the excavation and implementation of retaining structures (such as, soil walls) in conditions such as, loose granular soil formations, and high groundwater levels within the excavation site are rendered ineffective and expensive. This poses a serious challenge to civil engineers. Especially, in an urban setting, the employment of machinery is impractical as excavation sites in urban areas are surrounded by infrastructure. Owing to this, non-standard methods are implemented, which have time and again proved to be equally ineffective and expensive.

Hence, there is a long felt but unresolved need for a method that addresses the aforementioned issues.

SUMMARY OF THE INVENTION

An embodiment of the present invention comprises a comprehensive excavation process performed at an excavation site. The process includes a wellpoint-based dewatering method for lowering the groundwater level within the excavation site. The dewatering method includes inserting a plurality of pipe assemblies into the excavation site. A pipe assembly comprises a casing pipe, the bottom extremity of which is fitted with a casing filter so that, the groundwater is drawn therethrough for filtration. The pipe assembly further comprises a suction pipe fixedly disposed within the casing pipe. The bottom extremity of the suction pipe is fitted with a suction filter so that, the groundwater is drawn therethrough for further filtration. The space between the casing and suction pipes is filled with a filler up to the brim. The brim between the casing and suction pipes is sealed by a sealant thereby rendering the top extremity of the suction tube open.

The dewatering method further includes establishing a fluid communication between the pipe assemblies and a header pipe by connecting a flexible pipe between the suction tube and the header pipe. Once the connections are made, the dewatering method further includes drawing groundwater out of the header pipe by means of suction created by a dewatering pump.

The process further comprises an improved soil nailing method for stabilizing soil walls that define the boundaries of the excavation site. The soil nailing method includes installing a reinforcing mesh within the space between a soil wall and the corresponding pipe assemblies, shotcreting a shotcrete layer over the mesh upon the installation thereof, hammering, to the required depth, a plurality of downwardly oblique reinforcing bars into the soil wall via the reinforcing mesh and the shotcrete layer, shotcreting the reinforcing bars and the corresponding portion of the mesh upon insertion of the reinforcing bars and securing the bars to appropriate casing pipes whereby, the casing pipes too are rendered reinforcing elements.

One aspect of the present disclosure is directed to a comprehensive excavation process performed at an excavation site, the process comprising: (a) a wellpoint-based dewatering method for lowering the groundwater level within the excavation site, the method including: (i) inserting a plurality of pipe assemblies into the excavation site; a pipe assembly comprising: (1) a casing pipe, the bottom extremity of which is fitted with a casing filter so that, the groundwater is drawn therethrough for filtration; and (2) a suction pipe fixedly disposed within the casing pipe, the bottom extremity of the suction pipe fitted with a suction filter so that, the groundwater is drawn therethrough for further filtration, the space between the casing and suction pipes filled with a filler, the top of the filler is sealed by a sealant rendering the top extremity of the suction tube open; (ii) establishing a fluid connection between the pipe assemblies and a header pipe by connecting a flexible pipe between the suction tube and the header pipe; and (iii) drawing groundwater out of the header pipe by means of suction created by a dewatering pump; and (b) an improved soil nailing method for stabilizing soil walls that define the boundaries of the excavation site, the method including: (i) installing a reinforcing mesh within the space between a soil wall and the corresponding pipe assemblies; (ii) shotcreting a shotcrete layer over the mesh upon the installation thereof; (iii) hammering, to the required depth, a plurality of downwardly oblique reinforcing bars into the soil wall via the reinforcing mesh and the shotcrete layer; (iv) shotcreting the bars and the corresponding portion of the mesh upon insertion of the bars; and (v) securing the bars to appropriate casing pipes whereby, the casing pipes too are rendered reinforcing elements.

In one embodiment of the process, the top extremities of the casing and suction pipes are flush with one another. In another embodiment, the pipe assemblies are disposed closer to the boundaries of the excavation site. In one embodiment, the casing filter comprises crushed stone. In another embodiment, the filler comprises gravel. In one embodiment, the sealant comprises bentonite and cement.

Another aspect of the present invention includes a pipe assembly insertion comprising: (a) inserting an elongated mandrel within the casing pipe, the mandrel, when inserted within the casing pipe, extending beyond the top and bottom extremities of the casing pipe, a portion of the mandrel projecting from the top extremity of the casing pipe comprising block portion, the width of the which being more than the diameter of the top extremity of the casing pipe so as to prevent the mandrel from slipping into the casing pipe, the bottom extremity of the mandrel terminating in a pointed end for easier penetration, the top extremity of the mandrel terminating in a flat end; (b) hammering the mandrel and thereby the casing pipe to the depth required into the site; (c) removing the mandrel from the casing pipe once the casing pipe is at the required depth; (d) inserting a guide cylinder into the casing pipe, the guide cylinder for installing the casing filter at the bottom extremity of the casing pipe; (e) inserting the suction pipe within the casing pipe; (f) filling the filler within the space between the casing and suction pipes; and (g) sealing the top of the filler with the sealant.

In a related embodiment, the mandrel is hammered by one of a hydraulic and mechanical hammer. In another related embodiment, the pointed end discharges fluid jet enabling the mandrel along with the casing pipe to be easily plunged into the site. In yet another embodiment, the bottom extremity of the casing pipe forms a snug-fit with the bottom extremity of the mandrel.

In one embodiment, the bars are secured to the casing pipe by welding. In another embodiment, the reinforcing bars are perforated and hollow so as to enable injection of the grout through the perforations thereby grouting the area of the soil wall in the vicinity of the reinforcing bars resulting in the reinforcement of the reinforcing bars. In one embodiment, the distal extremity at which the reinforcing bar is hammered into the soil wall is pointed for ease of penetration. In another embodiment, upon insertion of the reinforcing bar into the soil wall, the angle between reinforcing bar and the horizontal ranges between 15° and 20°. In one embodiment, the reinforcing bar comprises a barbed steel pipe. In another embodiment, the reinforcing bar comprises a plurality of shear members attached to the distal portion thereof, the distal portion comprising the distal extremity that penetrates the soil wall as the reinforcing bar is hammered thereinto; the shear members for providing better anchorage.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

DETAILED DESCRIPTION

A description of embodiments of the present invention will now be given with reference to the figures. It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The invention disclosed herein generally relates to various methods employed on a typical excavation site. More particularly, the present invention teaches a comprehensive excavation process that takes of lowering groundwater levels and stabilizing soil walls.

Embodiments of the present invention are directed to a comprehensive excavation process that, in a way, integrates wellpoint-based dewatering method and soil nailing method. The process is particularly tailored to be employed within the context of urban construction, especially where soil is loose, silty and granular and where the groundwater level is high. The process is also tailored to be employed within area that is so limited that it doesn't allow for embankment operations involving the usage of heavy and bulky machinery. The excavation process is carried out on an excavation site defined by site boundaries.

The process includes a wellpoint-based dewatering method, which initiates with hammering a plurality of pipe assemblies into the site. A well point is defined as a hollow pointed rod with a perforated intake driven into an excavation to lower the water table by pumping and thus minimize flooding during construction. More particularly, the pipe assemblies are inserted into the site such that, they are disposed closer to the site boundaries and are equidistant from each other. As viewed from top, the line joining consecutive pipe assemblies is parallel to the site boundaries. Preferably, a distance between said line and the corresponding site boundary ranges between 1.5 to 2.5 meters.

Figure 2B:
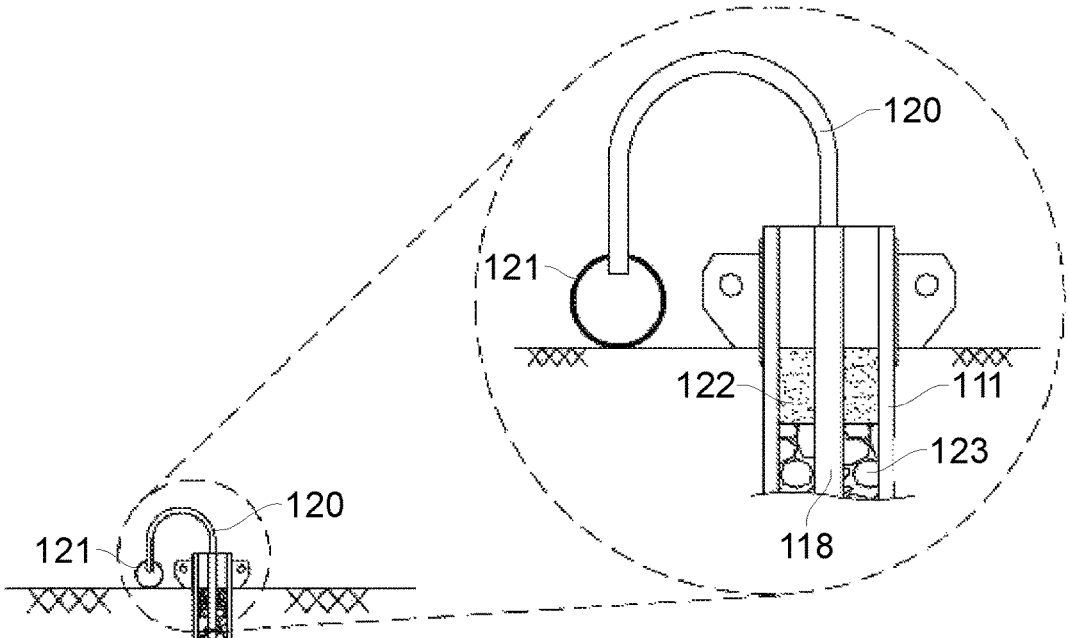
FIGS. 2A through 2C, according to an embodiment of the present invention, depict illustrations of a pipe assembly connected to a header pipe.
Figure 2A:
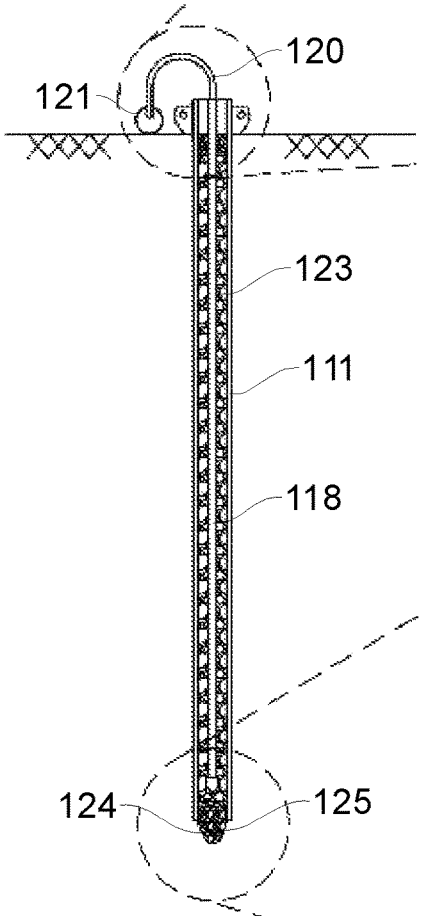
Figure 2C:
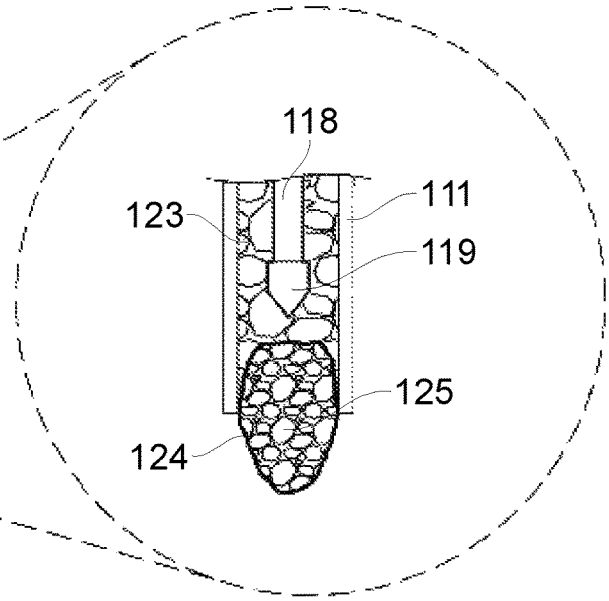

Referring to FIGS. 2A through 2C, a pipe assembly comprises an elongate casing pipe 111 extending between top and bottom extremities. The bottom extremity of the casing pipe 111 is fitted with a casing filter 125, which comprises crushed stone (preferably, small-sized), which is held together within a geotextile filter bag 124. The top extremity of the casing pipe 111 is fitted with a short cylindrical outer sleeve 110, which is attached with a pair of opposingly-disposed eyelet plates 109. More particularly, the outer sleeve 110 is welded to the casing pipe 111 for hardening of the upper part thereof. In a preferred embodiment, the diameter of the casing pipe 111 ranges between 20 and 25 centimeters, the length is nearly 1.3 times the depth of excavation.

Referring to FIGS. 2A through 2C, the pipe assembly further comprises an elongate suction pipe 118 centrally disposed within the casing pipe 111. The top extremities of the casing and suction pipes 111 and 118 are flush with respect to one another. The bottom extremity the suction pipe 118 terminates in a suction filter 119 wherein, the utility of the casing and suction filters 125 and 119 will become apparent from the following body of text. The space between the casing and suction pipes 111 and 118 is filled with filler 123 comprising gravel, or the like, almost up to the brim. At the brim, the space between the casing and suction pipes 111 and 118 are sealed by a sealant 122 comprising bentonite, cement, or a combination thereof. Notably, the top extremity of the suction pipe 118 is open-ended.

Figures 1A, 1B, 1C:
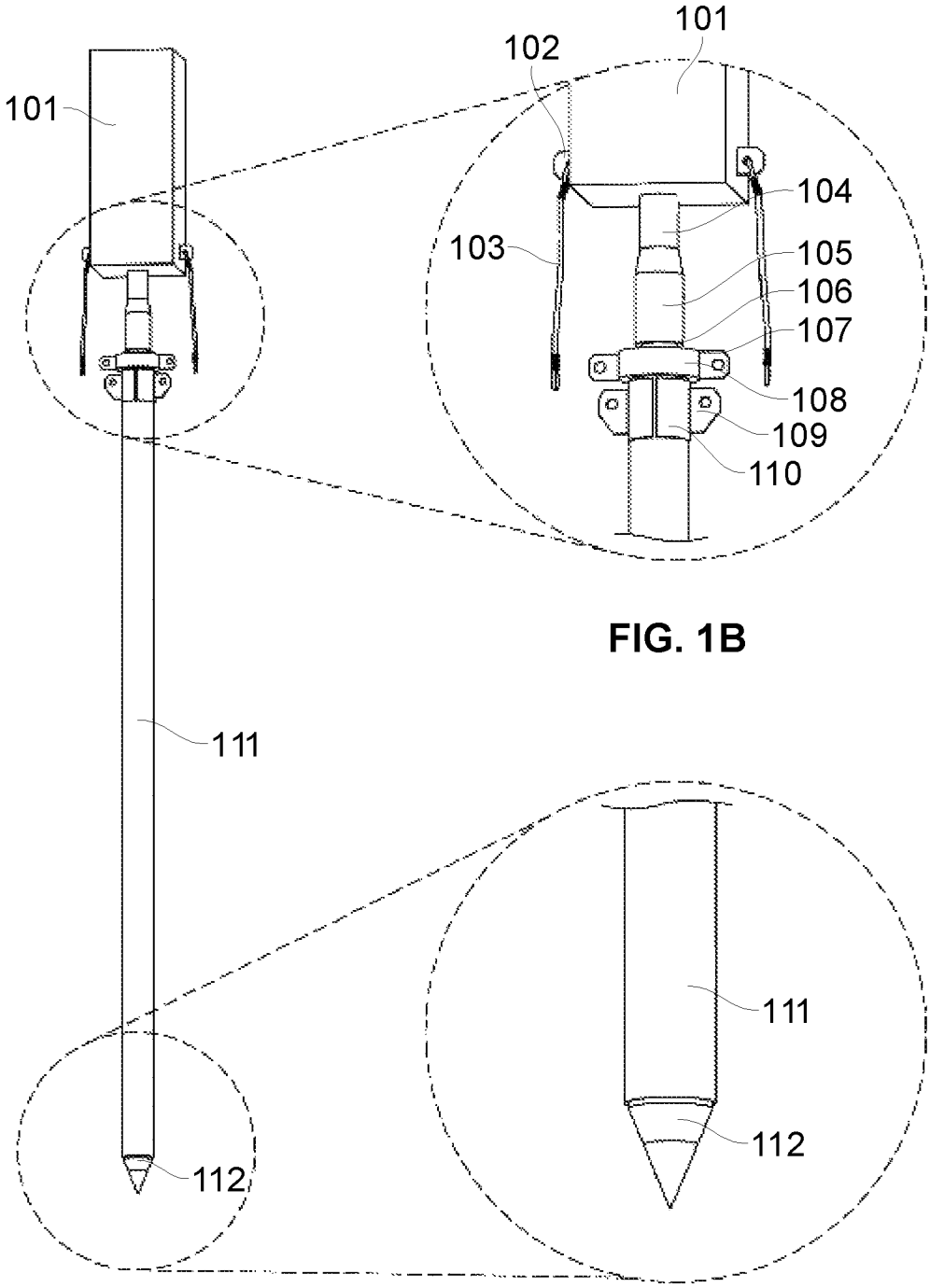
FIGS. 1A through 1C, according to an embodiment of the present invention, depict illustrations of a hammer engaging a mandrel inserted into the casing pipe.
Figure 3:
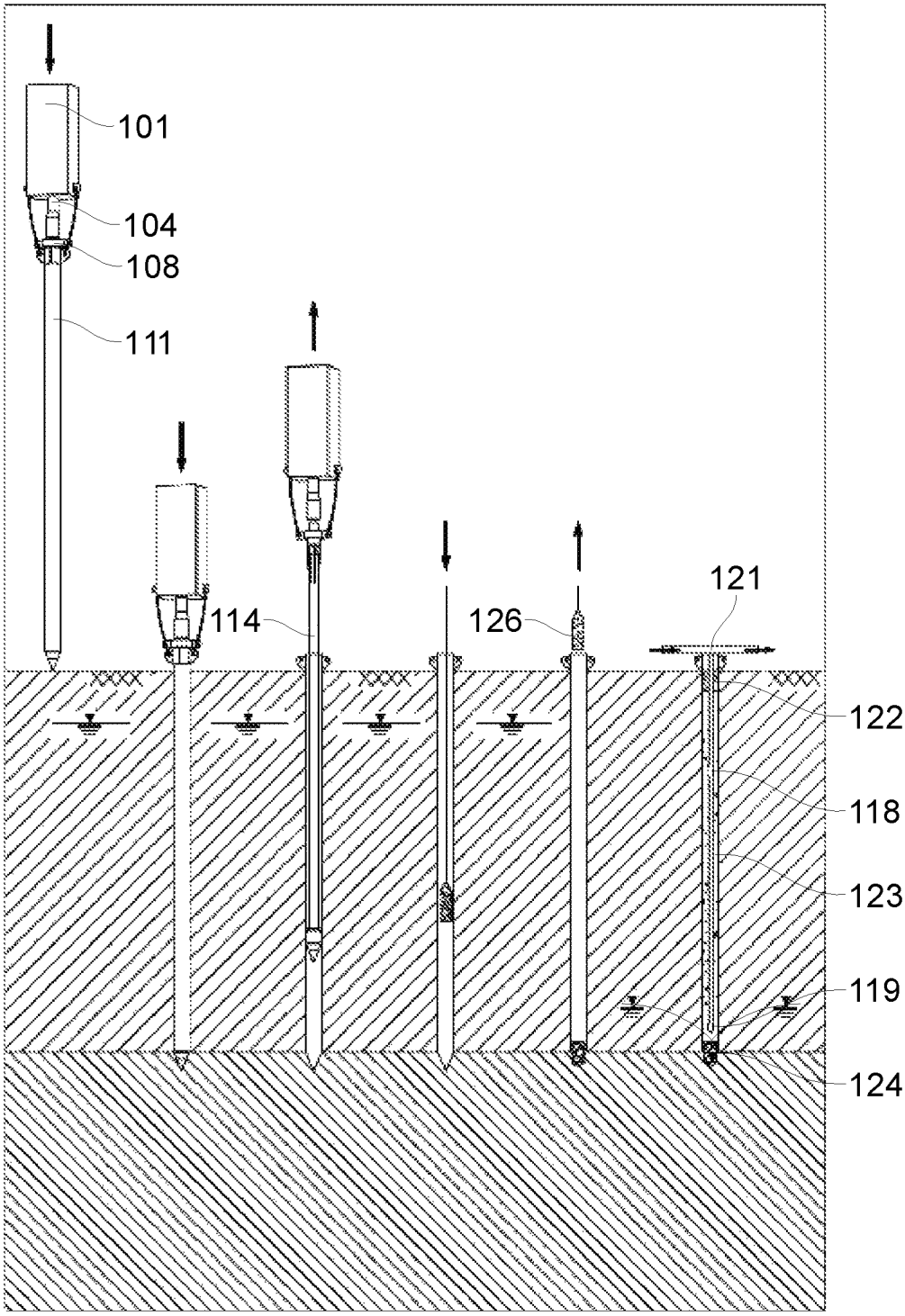
FIG. 3, according to an embodiment of the present invention, depict sequential illustrations in preparing a wellpoint.
Figure 4:
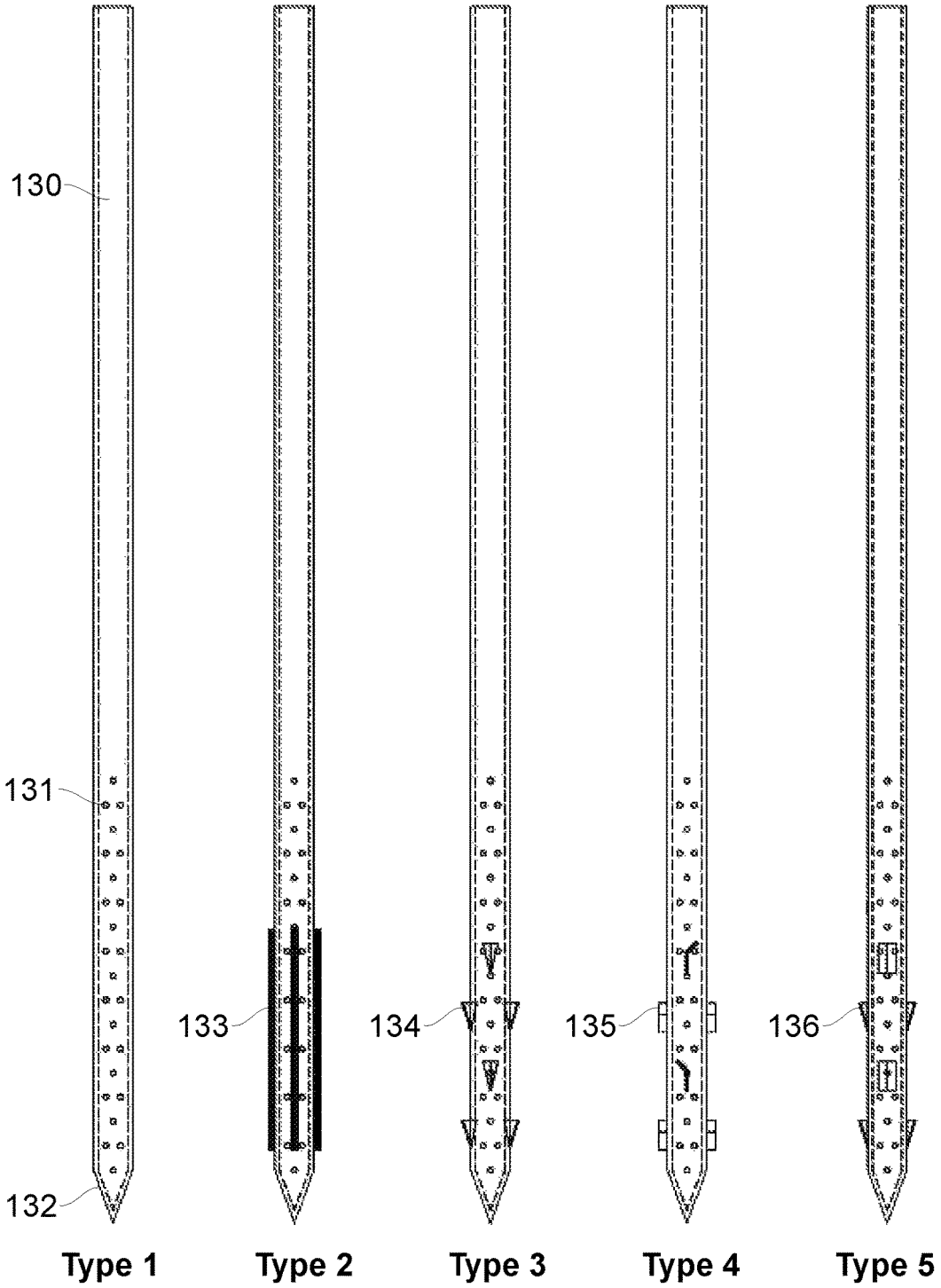
FIG. 4, according to an embodiment of the present invention, depict illustrations of various reinforcement bars.

As can be appreciated from FIGS. 1A through 111 and FIG. 3, the method of installing a pipe assembly initiates with inserting an elongate mandrel within the casing pipe 111 wherein, the top and bottom extremities of the mandrel extends beyond the top and bottom extremities of the casing pipe 111. The mandrel comprises an elongated shaft 114, the top of which is attached with a cylindrical segment 108, the diameter of which is greater than that of the casing pipe 111, thereby preventing the mandrel from slipping into the casing pipe 111. The cylindrical segment 108 is attached with a pair of opposingly-disposed eyelet plates 107. A head member 106 is attached atop the cylindrical segment 108. The head member 106 comprises a flat free extremity whereon the mandrel is hammered.

Figure 1E:
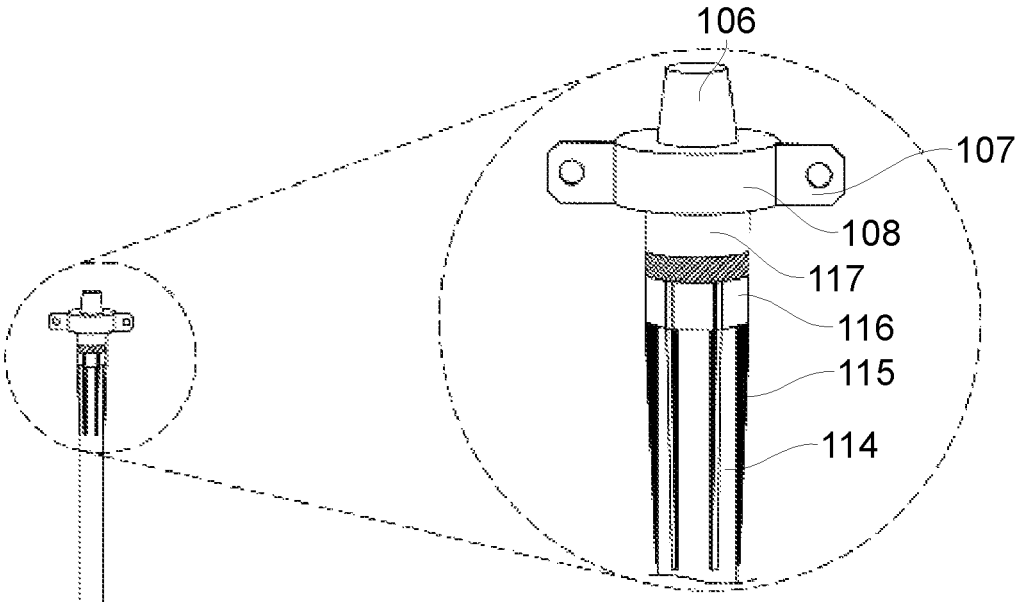
FIGS. 1D through 1F, according to an embodiment of the present invention, depict illustrations of a mandrel.
Figure 1D:
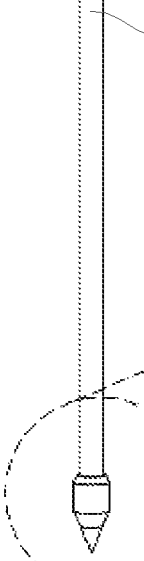
Figure 1F:
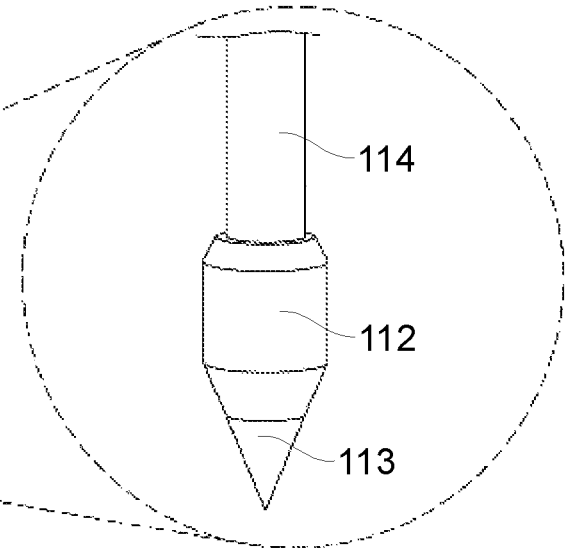
Figure 1G:
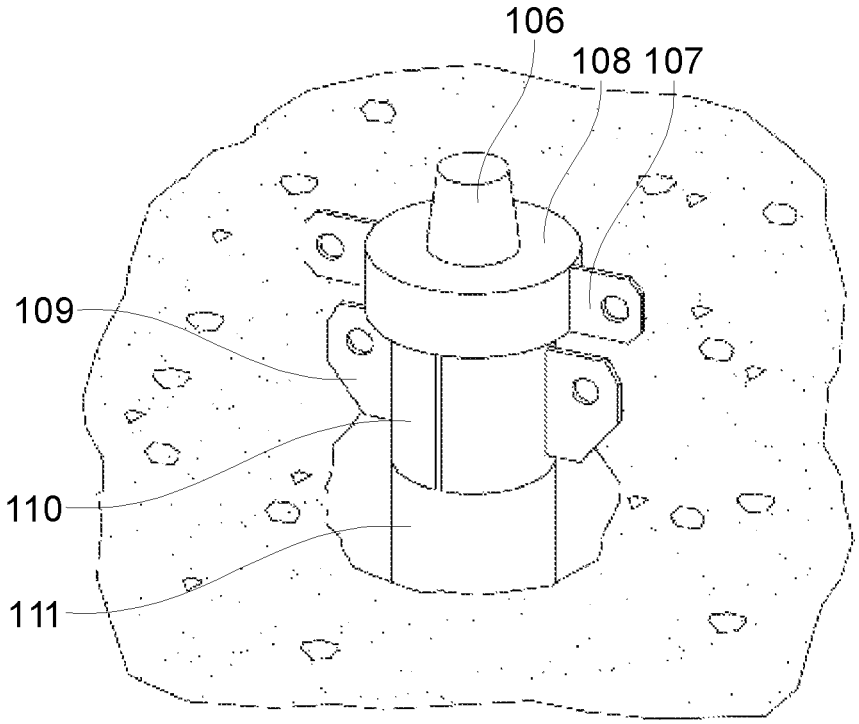
FIG. 1G, according to an embodiment of the present invention, depicts an illustration of the top portions of the mandrel engaging the casing pipe.

As can be appreciated from FIG. 1E, six guide triangular vertical plates 115 are welded to the shaft 114 for achieving a snug fit between the casing pipe 111 and the mandrel. The mandrel further comprises six connector plates 116 that are welded to the guide plates 115. Referring to FIG. 1F, the bottom end portion of the mandrel comprises a hollow cylindrical segment 112 for increasing the diameter of the casing pipe 111 as the mandrel is inserted into the casing pipe 111. The bottom extremity of the mandrel terminates in a pointed conical end 113 for easier penetration into the soil.

Referring to FIGS. 1A through 1G, once the mandrel is thoroughly inserted within the casing pipe 111 (at which point, the casing pipe 111 becomes one with the mandrel), the mandrel, and thereby the casing pipe 111, is hammered into site by means of a hydraulic or mechanical hammer 101 mounted on a mechanical excavator. As can be appreciated from FIGS. 1A and 1B, the hammer 101 comprises a rectangular housing with a pair of opposingly-disposed eyelet plates 102 extending from the sides thereof. A strand link 103 is secured to each eyelet 102 wherein, the strand link 103 assists in moving the mandrel and thereby the casing pipe 111 as the strand links 103 are secured to the eyelet plates 107. As can be appreciated particularly from FIG. 1B, from the bottom of the rectangular housing extends an impact shaft divided into upper and lower sections 104 and 105 wherein, the diameter of the upper section 104 is lesser than that of the lower section 105. More particularly, it is the lower section 105 that hammers the head 106 of the mandrel.

Referring to FIG. 3, the assemblage of a pipe assembly is carried out in six steps in order to lower the groundwater level 119. As seen in steps 1 and 2, the casing pipe 111 inserted with the mandrel is hammered into the ground (excavation site) by means of the aforesaid hammer 101. Once driven to the required depth, at step 3, the mandrel is withdrawn from the casing pipe 111.

Figure 1H:
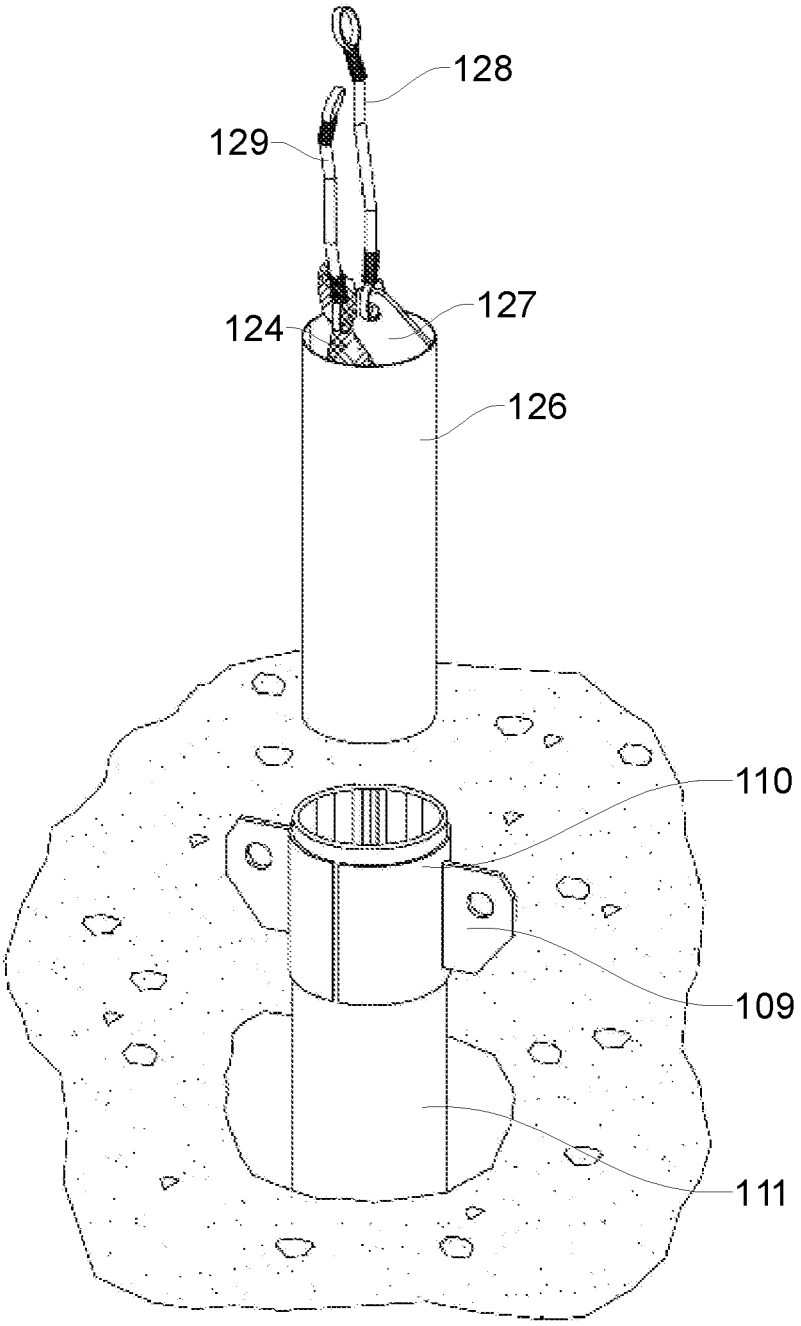
FIG. 1H, according to an embodiment of the present invention, depicts an illustration of guide cylinder being inserted into the casing pipe.

At step 4, as can be additionally appreciated from FIG. 1H, a guide cylinder 126 is inserted into casing pipe 111 from the top thereof upon the withdrawal of the mandrel. The guide cylinder 126 comprises a geotextile filter bag 124 carrying casing filter 125 (FIG. 2C), which comprises small-sized crushed stone. More particularly, the guide cylinder 126 is lowered into the casing pipe 111 by a strand link 128 connected to an eyelet plate 127 integrally formed with and disposed atop the guide cylinder 126. Once lowered till the bottom of the casing pipe 111, the filter bag 124 is secured to the bottom extremity of the casing pipe 111.

Upon the installation of the filter bag 124 at the bottom extremity of the casing pipe 111, the guide cylinder 126 is withdrawn out of the casing pipe 111 as shown in step 5. Finer adjustments of the filter bag 124 is carried out by adjusting a strand link 129 connected to the filter bag 124 as shown in FIG. 1H. On a side note, the filter bag 124 is employed so that, it prevents the risk of the filter material (i.e., the casing filter 125) adhering to the interior walls of the casing pipe 111.

Referring to FIG. 3, upon the installation of the filter bag 124, the aforementioned suction pipe 118 is installed within the casing pipe 111. As mentioned earlier, the space between the casing and suction pipes 111 and 118 is filled with filler 123 comprising gravel, or the like, almost up to the brim. At the brim, the space between the casing and suction pipes 111 and 118 are sealed by a sealant 122 comprising bentonite, cement, or a combination thereof, at which point a pipe assembly is formed. The top open extremity of the suction pipe 118 is connected to a horizontal header pipe 121 (disposed on the circumference of the excavation site) by means of a flexible U-pipe 120, which is usually made of plastic material, or the like.

The header pipe 121 is connected to a dewatering pump 147 (FIG. 7) wherein, upon the actuation of the pump 147, a suction is created forcing the groundwater to be suctioned out via the pipe assembly and the header pipe 121, ultimately leading to the lowering of the groundwater level 119 as seen in step 6. On a side note, the casing and suction filters 125 and 119 enable the filtration and further finer filtration of the groundwater respectively.

Figures 5A, 5B:
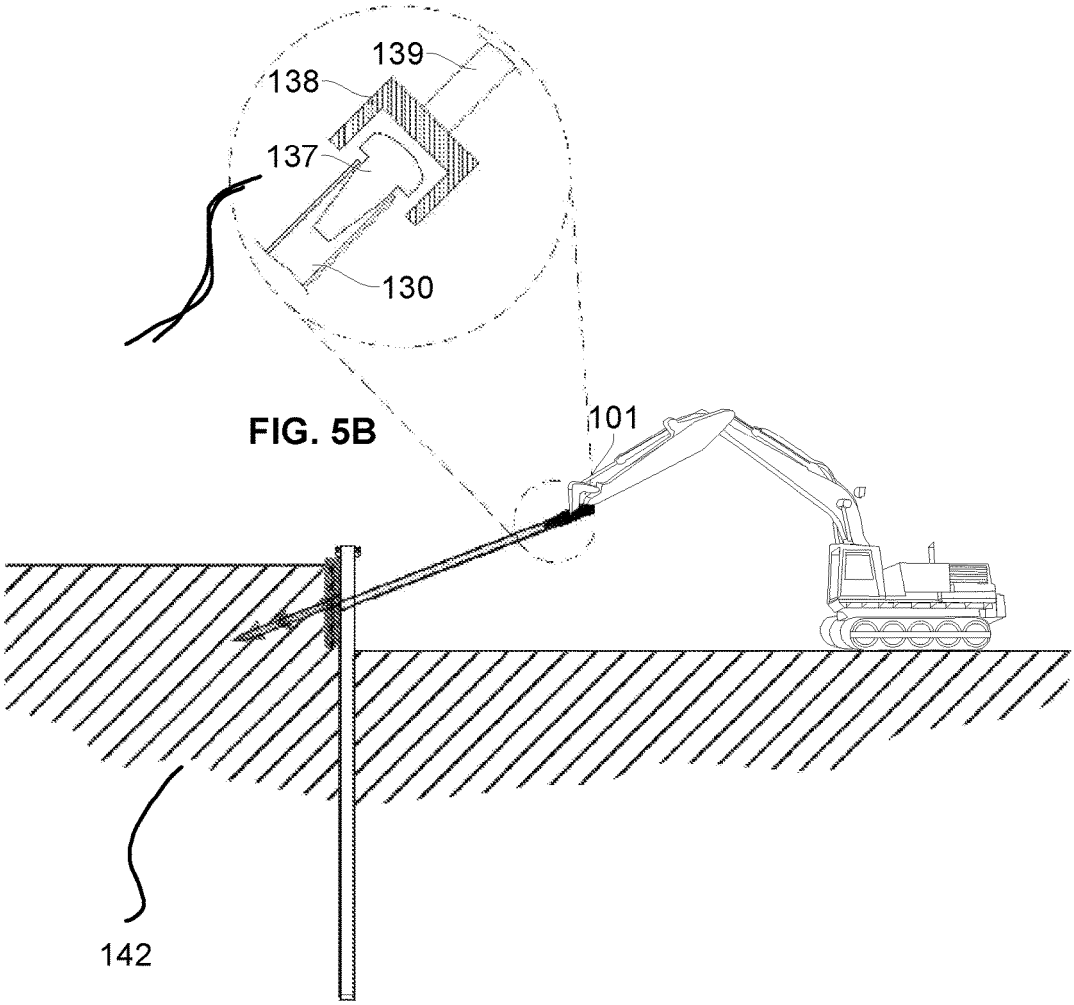
FIGS. 5A and 5B, according to an embodiment of the present invention, depict illustrations of a reinforcing bar being driven into a soil wall.
Figure 6:
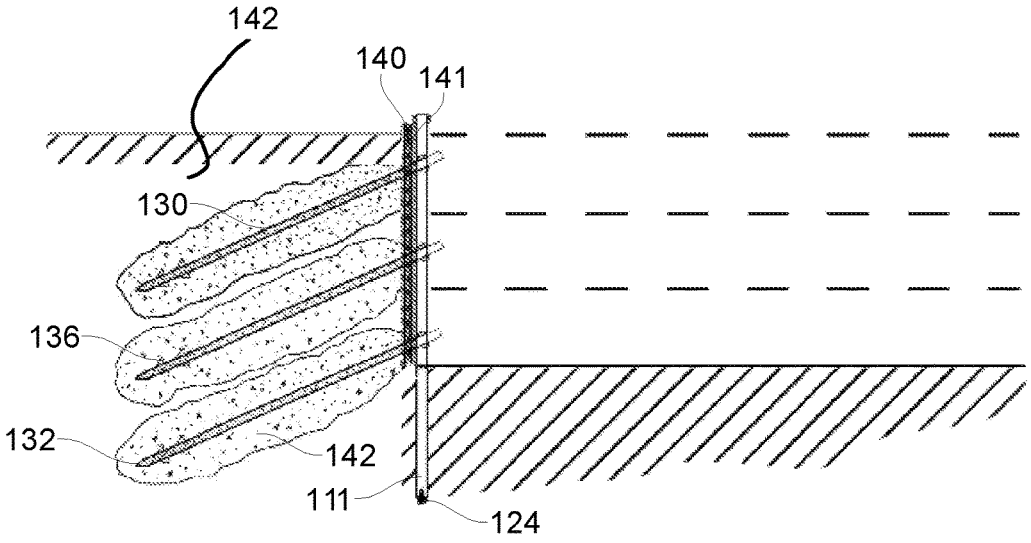
FIG. 6, according to an embodiment of the present invention, depicts an illustration of a plurality of vertically-aligned reinforcing bars inserted into the soil wall.
Figure 7:
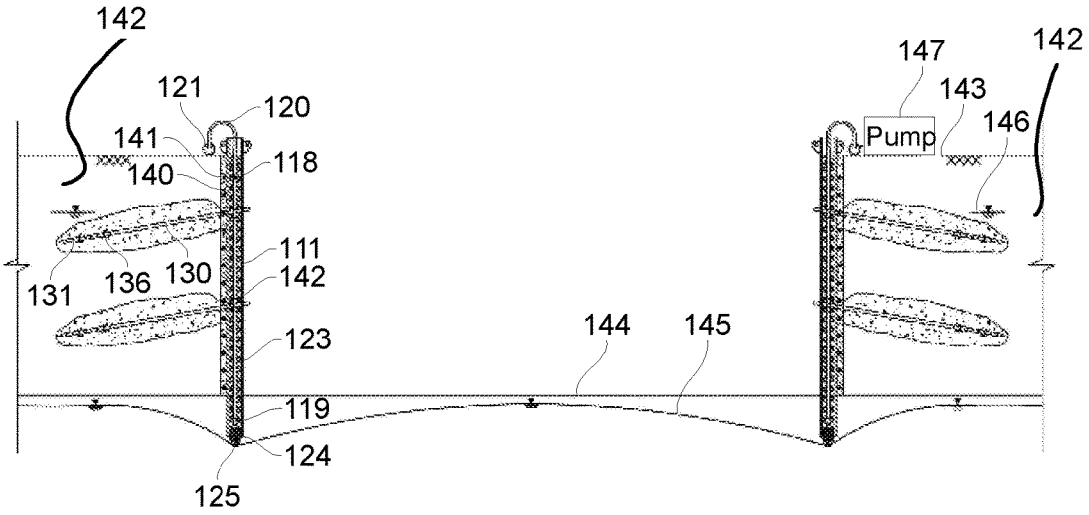
FIG. 7, according to an embodiment of the present invention, depicts an illustration reflecting wellpoint installation and soil wall stabilization within an excavation site.

The excavation process, which as mentioned earlier, further includes the soil nailing method that is integrated with the dewatering method, which has been described in detail in the preceding body of text. Referring to FIGS. 5A, 6 and 7, the soil nailing method initiates with installing a reinforcing mesh 140 between the soil wall 142 (formed as a result of excavation) and the pipe assemblies. Once the soil wall 142 reaches an appropriate height, the mesh 140 is layered with a layer 141 or two of shotcrete. This results in partial stabilization of the soil wall 142.

A plurality of reinforcing bars 130 are driven into the soil wall 142 via the shotcreted mesh 140 in a grid fashion. The horizontal distance between two horizontally-adjacent reinforcing bars 130 is maintained to be the same as the distance between two adjacent pipe assemblies. As the reinforced bars 130 are also vertically aligned (in a grid fashion), the vertically aligned reinforced bars 130 are inserted such that, the reinforced bars 130 are close to the pipe assemblies. Therefore, each pipe assembly corresponds to a plurality of vertically-aligned reinforced bars 130. Each reinforced bar 130 comprises a pointed distal extremity 132, about which the reinforced bar 130 is penetrated into the soil wall 142.

Referring to FIGS. 5A and 5B, a reinforced bar 130 is obliquely hammered into soil wall 142 via the mesh 140 and the shotcrete layer 141 by a mechanical or hydraulic hammer 101 (FIG. 5A) mounted on a mechanical excavator. More particularly, a mandrel 137 is employed between the hammer 101 and the reinforced bar 130 for driving the reinforcing bar 130 into the soil wall 142. Even more particularly, the hammer 101 comprises an impact shaft 139, which is connected to a cylinder 138 that has an axial opening. The cylinder 138 transfers the impact to the mandrel 137, which in turn conveys the same to the reinforcing bar 130. Once the reinforcing bar 130 is hammered to the required depth, the reinforcing bar 130 is secured to the corresponding pipe assembly by means of welding, or the like. Upon welding, the area surrounding the insertion of the reinforcing bar 130, including the corresponding pipe assembly is shotcreted whereby, the pipe assembly is rendered a reinforcing element in the soil nailing method.

Referring to FIGS. 4, 5A, 5B, 6 and 7, the reinforcing bar 130, in some embodiments, includes shear connections 133 to 136 so as to provide better tensile strength. In one embodiment, a reinforcement bar 130 comprises a hollow member with a plurality of perforations 131 disposed thereon. In this embodiment, the proximal extremity of the reinforcement bar 130 is open so as to receive cement slurry therewithin. Upon insertion into the soil wall 142, the cement slurry is injected into the soil wall 142 via the perforations 131. This grouting provides for better anchorage and soil compaction around the vicinity of the grout, which ultimately leads to better stabilization of the soil wall 142.

The method of the present disclosure further may comprises an improved soil nailing method for stabilizing soil walls that define the boundaries of the excavation site, the method comprising: (i) installing a reinforcing mesh within the space between a soil wall and the corresponding pipe assemblies; (ii) shotcreting a shotcrete layer over the mesh upon the installation thereof; (iii) hammering, to the required depth, a plurality of downwardly oblique reinforcing bars into the soil wall via the reinforcing mesh and the shotcrete layer; (iv) shotcreting the bars and the corresponding portion of the mesh upon insertion of the bars; and (v) securing the bars to appropriate casing pipes whereby, the casing pipes too are rendered reinforcing elements. The top extremities of the casing and suction pipes may be flush with one another. The pipe assemblies may be disposed closer to the boundaries of the excavation site, and the casing filter may comprise crushed stone. The filler may comprise gravel, and the sealant may comprise bentonite and cement.

Another aspect of the present invention includes a pipe assembly insertion comprising: (a) inserting an elongated mandrel within the casing pipe, the mandrel, when inserted within the casing pipe, extending beyond the top and bottom extremities of the casing pipe, a portion of the mandrel projecting from the top extremity of the casing pipe comprising block portion, the width of the which being more than the diameter of the top extremity of the casing pipe so as to prevent the mandrel from slipping into the casing pipe, the bottom extremity of the mandrel terminating in a pointed end for easier penetration, the top extremity of the mandrel terminating in a flat end.

The pipe assembly insertion further comprises hammering the mandrel and thereby the casing pipe to the depth required into the site; removing the mandrel from the casing pipe once the casing pipe is at the required depth; inserting a guide cylinder into the casing pipe, the guide cylinder for installing the casing filter at the bottom extremity of the casing pipe; inserting the suction pipe within the casing pipe; filling the filler within the space between the casing and suction pipes; and sealing the top of the filler with the sealant.

The mandrel may be hammered by one of a hydraulic and mechanical hammer. The pointed end may discharge fluid jet enabling the mandrel along with the casing pipe to be easily plunged into the site. The bottom extremity of the casing pipe may form a snug-fit with the bottom extremity of the mandrel. The bars may be secured to the casing pipe by welding. In one example, the reinforcing bars are perforated and hollow so as to enable injection of the grout through the perforations thereby grouting the area of the soil wall in the vicinity of the reinforcing bars resulting in the reinforcement of the reinforcing bars. The distal extremity at which the reinforcing bar is hammered into the soil wall may be pointed for ease of penetration. In one example, after insertion of the reinforcing bar into the soil wall, the angle between reinforcing bar and the horizontal ranges between 15° and 20°. The reinforcing bar may comprise a barbed steel pipe. In another example, the reinforcing bar comprises a plurality of shear members attached to the distal portion thereof, the distal portion comprising the distal extremity that penetrates the soil wall as the reinforcing bar is hammered thereinto; the shear members for providing better anchorage.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions.

Although specific terms may be employed herein, they are used only in generic and descriptive sense and not for purposes of limitation. Accordingly, the present invention is not limited to the specific embodiments illustrated herein. While the above is a complete description of the preferred embodiments of the invention, various alternatives, modifications, and equivalents may be used. Therefore, the above description and the examples should not be taken as limiting the scope of the invention, which is defined by the appended claims.

What is claimed is:

1. A comprehensive excavation process performed at an excavation site, the process including:

a method for lowering the groundwater level within the excavation site and for stabilizing soil walls that define the boundaries of the excavation site, the method including:

(i) excavating the ground to produce soil walls that define the boundaries of an excavation site;

(ii) inserting a plurality of pipe assemblies into the excavation site; each of the plurality of pipe assemblies comprising:

(1) a casing pipe, having a bottom extremity fitted with a casing filter so that, the groundwater is drawn therethrough for filtration and a top extremity at the opposite end of the casing pipe; and (2) a suction pipe, fixedly disposed within the casing pipe, containing a bottom extremity fitted with a suction filter so that the groundwater is drawn therethrough for further filtration, a space between the casing pipe and the suction pipe filled with a filler, a top of the filler sealed by a sealant rendering a top extremity of the suction pipe open;

(iii) establishing a fluid connection between each of the plurality of pipe assemblies and a header pipe by connecting a flexible pipe between the suction pipe of each of the plurality of pipe assemblies and the header pipe; and (iv) drawing the groundwater out of the header pipe by means of suction created by a dewatering pump; and (v) installing a reinforcing mesh within a space between a soil wall and the plurality of pipe assemblies;

(vi) shotcreting a shotcrete layer over the reinforcing mesh upon an installation thereof;

(vii) hammering a plurality of downwardly oblique reinforcing bars into the soil wall via the reinforcing mesh and the shotcrete layer;

(viii) shotcreting the reinforcing bars and the corresponding portion of the reinforcing mesh upon insertion of the reinforcing bars; and (ix) securing the reinforcing bars to the casing pipe of each of the plurality of pipe assemblies, whereby the casing pipe of each of the plurality of pipe assemblies are rendered reinforcing elements.

2. The process of claim 1 wherein, the top extremity of the casing pipe and the top extremity of the suction pipe are flush with one another.

3. The process of claim 1 wherein, the plurality of pipe assemblies are disposed closer to the boundaries of the excavation site.

4. The process of claim 1, wherein the casing filter comprises crushed stone.

5. The process of claim 1, wherein the filler comprises gravel.

6. The process of claim 1, wherein the sealant comprises bentonite and cement.

7. The process of claim 1, wherein the step of inserting the plurality of pipe assemblies includes:

(a) inserting an elongated mandrel, having a top extremity and a bottom extremity, within the casing pipe of each of the plurality of pipe assemblies, the mandrel, when inserted within the casing pipe, extending beyond the top and bottom extremities of the casing pipe, a portion of the mandrel projecting from the top extremity of the casing pipe comprising a block portion, the block portion having a larger diameter than the diameter of the top extremity of the casing pipe so as to prevent the mandrel from slipping into the casing pipe, the bottom extremity of the mandrel terminating in a pointed end for easier penetration, the top extremity of the mandrel terminating in a flat end;

(b) hammering the mandrel and thereby the casing pipe to the depth required into the excavation site;

(c) removing the mandrel from the casing pipe once the casing pipe is at the required depth;

(d) inserting a guide cylinder into the casing pipe, the guide cylinder for installing the casing filter at the bottom extremity of the casing pipe;

(e) inserting the suction pipe within the casing pipe;

(f) filling the filler within the space between the casing pipe and the suction pipe; and (g) sealing the top of the filler with the sealant.

8. The process of claim 7, wherein the mandrel is hammered by one of a hydraulic and a mechanical hammer.

9. The process of claim 7, wherein the pointed end discharges fluid jet enabling the mandrel along with the casing pipe of each of the plurality of pipe assemblies to be easily plunged into the excavation site.

10. The process of claim 7, wherein the bottom extremity of the casing pipe of each of the plurality of pipe assemblies forms a snug-fit with the bottom extremity of the mandrel.

11. The process of claim 1, wherein the reinforcing bars are secured to the casing pipe of each of the plurality of pipe assemblies by welding.

12. The process of claim 1 wherein, the reinforcing bars are perforated and hollow so as to enable injection of the shotcrete through the perforations thereby grouting the soil walls and resulting in the reinforcement of the reinforcing bars.

13. The process of the claim 1, wherein the extremity at which the reinforcing bar is hammered into the soil walls is pointed for ease of penetration.

14. The process of claim 1, wherein, upon insertion of the reinforcing bars into the soil walls, the angle between each of the reinforcing bar and the horizontal ranges between 15° and 20°.

15. The process of claim 1, wherein the reinforcing bars comprise barbed steel pipes.

16. The process of claim 1, wherein the reinforcing bars comprise a plurality of shear members attached to the bottom extremities thereof, the bottom extremities comprising the extremities that penetrate the soil walls as the reinforcing bars are hammered thereinto; the shear members for providing better anchorage.

* * * * *